United States Patent [19]

Beall et al.

[11] 4,321,158

[45] Mar. 23, 1982

[54] BACKFILL COMPOSITION FOR SECONDARY BARRIERS IN NUCLEAR WASTE REPOSITORIES

[75] Inventors: Gary W. Beall, Austin, Tex.; Bert M. Allard, Göteborg, Sweden

[73] Assignee: The United States of America as represented by the United States Department of Energy, Washington, D.C.

[21] Appl. No.: 154,639

[22] Filed: May 30, 1980

[51] Int. Cl.[3] ..... G21F 9/24

[52] U.S. Cl. ..... 252/628; 252/437; 252/455 Z; 252/457; 252/459; 405/128

[58] Field of Search ..... 252/301.1 W, 437, 455 Z, 252/457, 459; 405/128

[56] References Cited

PUBLICATIONS

Krajewski et al, "Mineral-Contributed Anion Effects. . .", *Trans. Am. Nucl. Soc. Ann. Meeting,* Atlanta, Ga. (Jun. 1979), pp. 164–165.

Beall et al, "Sorption Behavior of Trivalent Actinides and Rare Earths. . .", Rad. Wastes in Geol. Stor., *ACS Symposium Series 100,* Wash. D.C., (1978).

McCarthy, Ed. *Sci. Basis for Nucl. Waste Mgmt. vol. I,* Plenum Press, N.Y., (1979), pp. 403–410.

Allard et al, "Sorption of Amesicium on Geologic Media", *J. Environ. Sci. Health,* A14(6), pp. 507–518, (1979).

Beall et al., "Chemical Factors Controlling Actinide Sorption. . .", *Trans. Am. Nucl. Soc. Am. Meeting,* Atlanta, Ga. (Jun. 1979), pp. 164–165.

Allard et al, "The Sorption of Amesicium on Major Rock-Forming Minerals", *Trans. Am. Nucl. Soc. Am. Mtg.* Atlanta Ga. (Jun. 1979), pp. 167–168.

McCarthy et al, "Synthesis of Nuclear Waste Monazites. . .", *Mat. Res. Bull,* vol. 13, (1978), pp. 1239–1245.

*Primary Examiner*—Deborah L. Kyle

*Attorney, Agent, or Firm*—Fred O. Lewis; Stephen D. Hamel; Richard G. Besha

[57] ABSTRACT

A backfill composition for sorbing and retaining hazardous elements of nuclear wastes comprises 50–70% by weight of quartz, 10–30% by weight of montmorillonite, 1–10% by weight of phosphate mineral, 1–10% by weight of ferrous mineral, 1–10% by weight of sulfate mineral and 1–10% by weight of attapulgite.

10 Claims, 1 Drawing Figure

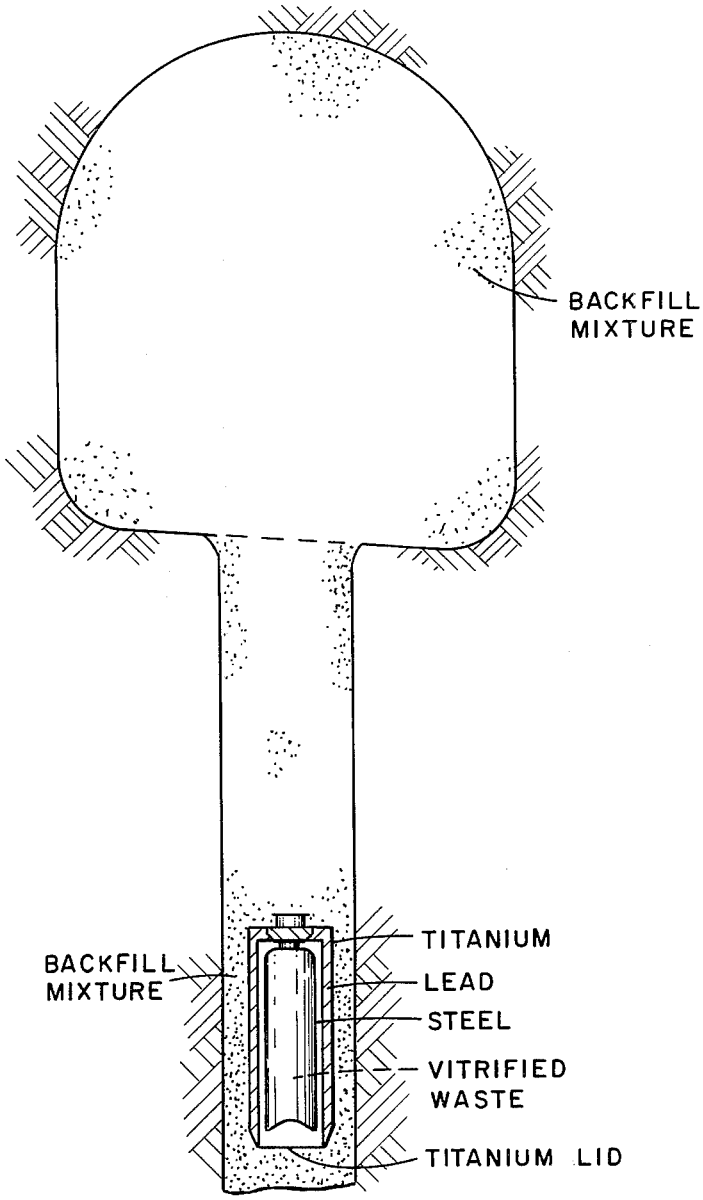
BACKFILL
MIXTURE
BACKFILL
MIXTURE
TITANIUM
LEAD
STEEL
VITRIFIED
WASTE
TITANIUM LID

BACKFILL COMPOSITION FOR SECONDARY BARRIERS IN NUCLEAR WASTE REPOSITORIES

BACKGROUND OF THE INVENTION

This invention is a result of a contract with the United States Department of Energy.

This invention relates to an improved backfill composition for use in reducing possible hazards caused by leakage of nuclear wastes from buried containers thereof.

The permanent isolation of reprocessed nuclear wastes or spent nuclear fuel having high levels of long-lived radioactive contaminants in subterranean repositories depends on the integrity of the repository if primary containment failure should occur. One approach has been use of underground disposal sites having physical structures and chemical properties which will assure retention of the hazardous elements.

Most suggested alternatives for deep underground disposal of high-level radioactive wastes rely on several independent barriers, including use of resistant canister materials, conversion of wastes to forms of low solubility in groundwaters and the use of back-fill materials of low permeability and high nuclide-retaining capacity, to retard the eventual release of radionuclides form the repository into the groundwater-bedrock system. The final and the only non-engineered barrier is the host rock. It would be desirable if the rock alone retained the long-lived radionuclides coming from the waste long enough to allow decay to harmless activity level before release to the biosphere.

The biologically hazardous products of high-level reprocessing wastes and unreprocessed spent uranium fuel are mainly the actinides and their daughter products (americium, plutonium, neptunium, thorium, radium), which are active for about three hundred years up to millions of years after discharge from the reactor. Elements such as radium and its fission products, e.g., cesium, strontium and technetium, are also of concern in the context of long-term storage of nuclear waste.

Because the actinides present the most serious long-range health hazard associated with nuclear wastes, special emphasis has been given to determining which minerals have sufficient sorptive capacity to retain these elements.

A mixture of quartz and montmorillonite has been suggested as a secondary barrier or backfill material which will ensure the retention of all the hazardous nuclides in buried nuclear wastes. "Handling of Spent Nuclear Fuel and Final Storage of Vitrified High-Level Waste" and "Handling of Spent Nuclear Fuel and Final Storage of Unreprocessed Spent Fuel," Karnbranslesakerhet, KBS, Stockholm (1977 and 1978).

The quartz in the mixture provides the mixture with thermal and structural integrity and the montmorillonite functions as a strong cation exchanger and provides an impervious elastic barrier to water flow. This mixture has many of the qualities desired in a secondary barrier, but it has insufficient sorptive capacity to remove penta- and hexa-valent actinide materials.

Beall et al have studied sorption of trivalent actinides and rare earths on clay minerals, as reported in "Radioactive Wastes in Geological Storage," ACS Symposium Series 100, Washington, D.C. (1978), pages 201–203, incorporated herein by reference. Distribution coefficient determinations between various clays and brines containing trivalent actinide tracers indicate that attapulgite takes up considerably more rare earths, actinides and cesium than would be predicted on the basis of ion-exchange capacity.

Beall et al, "Chemical Factors Controlling Actinide Sorption in the Environment," Trans. Am. Nucl. Soc. Ann. Meeting, Atlanta, Ga. (June 1979) at 164–165, incorporated herein by reference, determined that retention of actinides in a subterranean environment is affected both by the solid geologic medium and the composition of the aqueous phase in equilibrium therewith. Sorption of actinides depends on their chemical form which, in turn, depends on pH, redox potential and anion content of the water, especially with respect to carbonate, fluoride and phosphate ions and organic acids.

Determination of sorption of americium on major rock-forming minerals was reported by Allard et al, ibid., at 167, incorporated herein by reference. The effect of anions on absorption of trivalent actinides as a function of pH is reported by Krajewski et al, ibid. at 168, incorporated herein by reference. See also, Allard et al, "Sorption of Americium on Geologic Media," *J. Envir. Sci. Health,* Part A, 14, 6 (1979).

The sorption of Am(III) and Np(V) by two granites and some major minerals of igneous rocks, including quartz, microcline, albite, bytownite, biotite, hornblende, augite, olivine, and kaolinite from an aqueous phase of an artificial groundwater at pH 4–9 has been studied. Allard et al, "The Sorption of Actinides in Igneous Rocks," *Nuclear Technology* (in press), incorporated herein by reference.

It is apparent that selection of materials which will retain radionuclides leaking into underground repositories for nuclear wastes is a complex problem, the solution of which is of critical importance in making the use of nuclear fuels socially and ecologically acceptable both for the present and for future generations, who must be protected from exposure to harmful nuclear materials.

OBJECT OF THE INVENTION

It is an object of this invention to provide a combination of naturally-occurring minerals having sorptive capacity sufficient to retain hazardous elements present in nuclear wastes. The mixture contains phosphate mineral, sulfate mineral, ferrous mineral and clay mineral, in addition to quartz and montmorillonite, which provide thermal and structural stability and resistance to water transport, respectively.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWING

The single drawing shows a nuclear waste repository backfilled in accordance with the invention.

DETAILED DESCRIPTION

"Quartz," as used in the specification and claims, means silicon dioxide.

"Montmorillonite," as used in the specification and claims, means an aluminosilicate clay of the empirical formula $Al_2Si_4O_{10}(OH)_2XH_2O$. It is a high alumina expanding clay, which can be grayish or pale red or blue in color, and in which some of the aluminum can be replaced by magnesium. This type of clay has a layered structure of aluminum-oxygen tetrahedra and of silicon-oxygen tetrahedra as discussed in Grim, "Clay Mineralogy," 2nd ed., McGraw-Hill, New York (1968).

"Phosphate mineral," as used in the specification and claims, includes but is not limited to apatite, monazite, triphylite, amblygonite, lazulite, wavellite, vivianite, and mixtures thereof.

Apatite, which is preferred, is a calcium chloro- or fluorophosphate of the empirical formula $Ca_3(PO_4)_2.CaF_2$, $Ca_3(PO_4)_2.CaCl_2$ and $Ca_5$ (F, Cl, OH) $(PO_4)_3$. Some of the calcium can be replaced by lead and some of the phosphorus by arsenic. "Ferrous mineral," as used in the specification and claims, includes but are not limited to olivine, garnet, magnetite, pyrite, arsenopyrite, bornite, cholcopyrite, layalite, and illmenite, and mix-tures thereof. Of these, olivine, garnet, magnetite and pyrite are preferred. Olivine and magnetite are most preferred.

Olivine is an olive-green magnesium iron silicate which crystallizes in the orthorhombic system, the composition of which is represented by the formula $(Mg, Fe)_2SiO_4$.

Garnet is a generic term for silicates isometric in crystallization and having the formula $A_3B_2(SiO_4)_3$, in which A is Fe(II), Mn(II), Ca or Mg and B is Fe(III), Al, Cr(III) or Ti(III). It will be understood that garnets containing ferrous iron are preferred for utilization in the backfill compositions of this invention.

Magnetite is iron (II, III) oxide, represented by the formula $FeO.Fe_2O_3$.

Pyrite is iron sulfide ($FeS_2$).

Attapulgite is a magnesium aluminum silicate clay mineral represented by the empirical formula $(Mg, Al)_2Si_4O_{10}(OH).4H_2O$. Attapulgite has a needle-like crystalline structure. See Grim, supra.

Sorption of americium, a representative long-lived nuclide, on common minerals of igneous rocks increased from quartz, feldspars and argite, olivine, kaolinite to biotite. Apparently anomalous absorption on hornblendes was attributed to the presence of calcite as an impurity, which acts as a buffer to pH 7–8.5.

The cation exchange capacities of the various minerals with respect to $Na^+$ was correlated roughly with their specific surfaces. There was no quantitative relationship between cation exchange capacity and sorption of americium, except for generally higher sorption on minerals having higher cation exchange capacity and specific surface.

Similar sorptions isotherms were obtained for neptunium solutions. As was the case for Am, there was an increase in distribution coefficient with pH above about 7–7.5. This is attributed to hydrolysis of Am and Np, which is typical behavior for trivalent actinides.

Sorption studies on granite rocks gave reasonably good agreement between the experimentally determined values of the distribution coefficients of Am and Np and those calculated from values of the individual components of the granite samples. Accordingly, prediction of distribution coefficients of rock mixtures based on values determined for individual components appears feasible.

Experimental determination of the effect of anions on sorption of actinides indicated that apatite and anhydrite were particularly effective sorbents.

A combination of naturally occurring minerals has been found which is uniquely suited for sorption of all hazardous nuclides in radioactive wastes. The combination of minerals includes quartz, montmorillonite, phosphate-containing mineral such as apatite, sulfate mineral such as anhydrite, ferrous mineral such as magnetite and clay mineral such as attapulgite.

It is proposed that the phosphate mineral sorbs the actinides of all valence states by a strong chemisorption reaction; the sulfate mineral causes precipitation of the fission products Sr and Ra as insoluble sulfates; the ferrous mineral reduces the higher valent actinides and $TcO_4^-$ to the more readily sorbed III and IV valent states; and attapulgite sorbs both actinides and cesium. It is proposed that rare earth fission products will be sorbed in a manner similar to the trivalent actinides. Quartz provides thermal and structural stability to the mixture and montmorillonite forms an impervious elastic barrier to water flow and serves as a strong cation exchanger. Although the specific mechanism by which each mineral sorbs radioactive products is not known at this time, the collective sorptive activity of the combination of this invention provides an effective backfill material for use in nuclear waste repositories.

However, it appears that minerals having anions that interact strongly with the actinides or their fission products, particularly phosphate, sulfate- and carbonate-containing minerals, are of most interest. Phosphate minerals, including apatite and monazite are proposed for use in nuclear waste repositories because our sorption data for apatite indicate that it sorbs the III, V and VI valent states of the actinides strongly in the pH range of the underground environment. Actinides in the IV valence state are expected to be sorbed in a fashion similar to the III state.

The sulfate-containing mineral anhydrite ($CaSO_4$) apparently immobilizes Sr and Ra because the solubility products of their sulfate salts are $10^{-9}$ and $10^{-11}$, respectively.

The carbonate-containing minerals, calcite and dolomite, sorb the II, III and V valent states strongly and buffer the solutions to pH values at which sorption is maximal. However, phosphate-containing minerals are preferred because they sorb the very mobile hexavalent actinides strongly, whereas carbonate-containing minerals tend to solubilize and increase the mobility of the hexavalent actinides.

Ferrous minerals are expected to reduce the higher valent actinides [U(IV), Np(V), Pu(VI) and Tc(VII)], to their strongly-sorbed tetravalent states. The combination of ferrous mineral with carbonate mineral would eliminate the problem caused by soluble carbonate complexes of VI valent actinides.

The clay mineral attapulgite has a high affinity for all valence states of the actinides and for cesium. The sorption reaction of attapulgite differs from that of the phosphate minerals and appears to be a cation exchange reaction, which is enhanced by the open channel structure of the attapulgite. It further appears that these channels are sufficiently large to accomodate ions such as Am(III), $NpO_2^+$, $UO_2^{2+}$ and $Cs^+$.

Nuclear wastes, which may be vitrified, are sealed in a conventional manner in canisters. A typical canister construction, shown in the drawing, consists of a thin chromium-nickel steel casing, a thick intermediate layer of lead and a thin outer layer of titanium. The canisters are placed in holes or tunnels in the earth, such as bedrock or salt beds, to the designed capacity of the repository. The repository can be kept open for inspection to assure that drainage and ventilation systems are functioning properly.

Prior to final abandonment of the repository, the backfill composition of this invention is used to fill holes around the canisters and vertical shafts. Conventional earth-moving and compacting equipment is used for filling the lower portions of the excavation; the higher portions can be filled by spraying.

Expansion of the backfill composition as the clay components swell owing to absorption of water ensures that the shafts, tunnels and holes will be completely filled with a material which is at least as impervious to harmful nuclides as the surrounding rock. In addition, the swollen backfill material prevents or reduces the effects of minor rock movement on the canisters.

DESCRIPTION OF PREFERRED EMBODIMENTS

Preferred backfill compositions are those comprising 55–65% by weight of quartz, 15–25% by weight of montmorillonite, 3–7% by weight of apatite, 3–7% by weight of olivine, garnet, magnetite or pyrite, 3–7% by weight of anhydrite and 3–7% by weight of attapulgite. The compositions are well suited for use in bedrock, salt beds, and the like. Most preferably, the ferrous mineral in these compositions is magnetite or olivine.

In the method of this invention, use of the corresponding backfill compositions is preferred.

Without further elaboration, it is believed that one skilled in the art can, using the preceding description, utilize the present invention to its fullest extent. The following specific embodiments are, therefore, to be construed as merely illustrative and not limitative of the remainder of the disclosure in any way whatsoever. In the following Examples, the temperatures are set forth uncorrected in degrees Celsius. Unless otherwise indicated, all parts and percentages are by weight.

EXAMPLE 1

Sorption of Americium and Neptunium on Rocks and Minerals

The sorption of Americium and neptunium on rocks and minerals was measured as a function of pH using the batch technique of Allard et al, *J. Envir. Sci. Health, supra.* All minerals were obtained from Ward's Natural Science Establishment and the rocks from Pacific Northwest Laboratory. The purity of the minerals was checked by X-ray diffractometry. Existing impurities were reasonably low (within 5 percent).

The following sorbents were studied:

| Mineral/Rock | Chemical Composition |
|---|---|
| Quartz | $SiO_2$ |
| Microcline (orthoclase feldspar) | $KAlSi_3O_8$ |
| Albite (plagioclase feldspar) | $NaAlSi_3O_8$ |
| Bytownite (plagioclase feldspar) | $CaAl_2Si_2O_8$[a] |
| Biotite (mica) | $K(Mg,Fe)_3(AlSi_3O_{10})(OH)_2$ |
| Hornblende (amphibole) | $Ca_2Na(Mg,Fe)_4(Al,Fe)_3Si_8O_{22}(O,OH)_2$[b] |
| Augite (pyroxene) | $(Ca,Na)(Mg,Fe,Al)(Si,Al)_2O_6$ |
| Olivine | $(Mg,Fe)_2SiO_4$ |
| Kaolinite | $Al_4(Si_4O_{10})(OH)_8$ |

-continued

| (clay mineral) | | |
|---|---|---|
| | Feldspars | 62% |
| Climax Stock Granite[c] | Quartz | 28% |
| | Biotite | 10% |
| | Feldspars | 67% |
| | Quartz | 25% |
| Westerly Granite[c] | Biotite | 5% |
| | Magnetite | 2% |
| | Muscovite | 1% |

[a]Contains 10–20% albite
[b]Contains 5% calcite ($CaCO_3$)
[c]L. L. Ames, "Waste Isolation Assessment Program Controlled Sample Program, Publ. No. 1, Characterization of Rock Samples," PNL-2797, UC-70, Pacific Northwest Laboratory, Richland, Wa. (1978); contents of clay mineral not given.

The solid minerals and rocks were crushed in a mortar, to avoid iron contamination, and sieved. The size fraction 0.044–0.063 mm was used in the sorption experiments. The cation exchange capacity with respect to $Na^+$ was measured by a batch-technique, Francis et al, *Soil Sci.,* vol. 112 (1971) at 17. The specific surfaces were determined by the ethylene glycol method, Bauer et al, *Soil Sci.,* vol. 87 (1959) at 289. The crushed and sieved solid material was prewashed with groundwater solution for five days. The solid phase was allowed to settle by gravity and the washing solution was discharged. After a second prewash, a known amount of groundwater was added and the system was allowed to pre-equilibrate for five days before addition of the active spike solution.

The groundwater solution had a pH of 8.2, a total salt content of 306 mg/l and was of the following ionic composition:

| Species | Concentration mg/l | Species | Concentration mg/l |
|---|---|---|---|
| $HCO_3^-$ | 123 | $Ca^{2+}$ | 18 |
| $SO_4^{2-}$ | 9.6 | $Mg^{2+}$ | 4.3 |
| $Cl^-$ | 70 | $K^+$ | 3.9 |
| $SiO_2$ (total) | 12 | $Na^+$ | 65 |

Active spike solutions were prepared by adding acidic (0.1 M HCl) stock solutions ($10^{-5}$ M $^{241}Am$ solution or $3\times10^{-8}$ M $^{235}Np$ solution) to groundwater solution and adjusting pH to pH 7–7.5 by addition of 0.1 N NaOH. After about a week, the solutions were centrifuged (5h at 4000 g) and then used for spiking by adding $\leqq 1$ ml of spike solution to 25–35 ml groundwater sample solution containing 0.2–0.5 g of solid sample. The initial concentrations of the sample solutions were $2\times10^{-9}$ M of americium or $2\times10^{-11}$ M of neptunium, respectively.

After a five day contact time, the aqueous phase was separated from the solid by centrifugation (1h at 4000 g). The concentration of radionuclide remaining in solution was measured using a well-type NaI scintillation counter.

Blank samples were run in order to measure the adsorption on the walls of the vials, but no correction for adsorption was made in the final calculations of sorption on the minerals. The sorption on the walls was expected to be negligible in the presence of crushed minerals or rocks, which presented a very large active surface (up to tens of $m^2$) in comparison with the exposed surface of the vial. See Erdal et al, "Sorption-Desorption Studies on Granite," La-7456-MS, Los Alamos Scientific Laboratories (1978).

A series of runs at pH 8 on various rock-forming minerals indicated the following correlation between mineral composition, exchange capacity for $Na^+$, specific surface and distribution coefficients ($K_d$ is moles/kg solid per moles/$m^3$ water):

| Mineral | Capacity[a] meq/kg | Spec surface[b] $m^2/g$ | log K $m^3/kg^d$ Am | Np |
|---|---|---|---|---|
| Quartz | 0.2 | 2.8 | −0.1 | −1.3 |
| Microcline | 3.7 | 4.2 | 0.9 | −1.5 |
| Albite | 4.0 | 2.9 | 0.8 | −1.5 |
| Bytownite | 8.2 | 3.1 | 0.9 | −1.4 |
| Biotite | 17 | 14 | 1.3 | −0.7 |
| Hornblende | 2.8 | 4.6 | 1.5 | −1.3 |
| Augite | 8.2 | 6.3 | 0.8 | −1.3 |
| Olivine | 0.3 | 5.0 | 0.9 | −1.1 |
| Kaolinite | 28 | 27 | 1.3 | −1.0 |

[a]For $Na^+$ at pH 8
[b]Particle size 0.044–0.063 run

EXAMPLE 2

Distribution Coefficients for Americium and Neptunium on Granite

Equilibration experiments were carried out as in Example 1, using granite samples and varying pH of the nuclide-containing solutions. The distribution coefficients were also calculated using weighted average values of the individual component minerals of the granites, without compensating for accessory minerals or weathering products (clay minerals). Results were:

| Rock | log K $m^3/kg^d$ Am pH 5 | Am pH 8 | Np pH 5 | Np pH 8 |
|---|---|---|---|---|
| Climax stock measured | 0.2 | 1.3 | (−1.7) | −1.0 |
| granite calculated | −0.1 | 0.9 | −1.8 | −1.3 |
| Westerly measured | −0.5 | 0.4 | −1.9 | −1.5 |
| granite calculated | −0.2 | 0.8 | −1.8 | 1.3 |

EXAMPLE 3

Anion Effect on the Sorption of Actinides on Selected Minerals

Experiments were carried out as in Example 1, using mineral samples of particle size 0.04–0.06 mm and aqueous phases consisting of synthetic groundwater, as above, or 0.1–4 M NaCl solution.

The following initial radionuclide concentrations were employed in the spike solutions:

$^{241}Am^{3+} = 10^{-9}$ Molar $^{235}NpO_2^{+} = 10^{-10}$ Molar $^{237}UO_2^{2+} = 10^{-12}$ Molar Results at pH 8.0, using synthetic groundwater, were:

| Mineral | Distribution Coefficients (l/kg) $^{241}Am^{3+}$ | $^{235}NpO_2^{+}$ | $^{237}UO_2^{2+}$ |
|---|---|---|---|
| Apatite ($PO_4^{3-}$) | ~20,000 | 20,000 | 2,000 |
| Marble ($CO_3^{2-}$) | ~10,000 | 2,000 | 9 |
| Fluorite ($F^-$) | ~10,000 | 3 | 3 |
| Anhydrite ($SO_4^{2-}$) | ~5,000 | 6 | 3 |

EXAMPLE 4

Preparation of Backfill Composition

A backfill composition is prepared by blending the following minerals:

| % by weight | Particle Size | Mineral |
|---|---|---|
| 60 | 100 μm | Quartz |
| 20 | | Montmorillonite |
| 5 | 100 μm | Apatite |
| 5 | " | Olivine |
| 5 | " | Anhydrite |
| 5 | " | Attapulgite |

The composition is employed at a nuclear waste disposal site for wastes sealed in canisters as described by KBS, Stockholm, supra.

EXAMPLE 5

Backfill Compositions

Additional backfill compositions are obtained by blending the following minerals (particle size, 100 μm).

| | % by weight | Mineral |
|---|---|---|
| (a) | 58 | Quartz |
| | 21 | Montmorillonite |
| | 5 | Apatite |
| | 6 | Magnetite |
| | 5 | Anhydrite |
| | 5 | Attapulgite |
| (b) | 61 | Quartz |
| | 19 | Montmorillonite |
| | 5 | Apatite |
| | 5 | Garnet |
| | 4 | Anhydrite |
| | 6 | Attapulgite |
| (c) | 59 | Quartz |
| | 20 | Montmorillonite |
| | 4 | Apatite |
| | 6 | Pyrite |
| | 6 | Anhydrite |
| | 5 | Attapulgite |

The preceding examples can be repeated with similar success by substituting the generically or specifically described reactants and/or operating conditions of this invention for those used in the preceding examples.

The foregoing description has been presented for purposes of illustration and description. It is not intended to be exhaustive or to limit the invention to the precise form S disclosed, and obviously many modifications and variations are possible in light of the above teaching. The examples have been described to best explain the principles of the invention and its practical application to thereby enable others skilled in the art to best utilize the invention in various embodiments and with various modifications as are suited to the particular use comtemplated. It is intended that the scope of the invention be defined by the claims appended hereto.

What is claimed is:

1. A backfill composition for sorbing and retaining hazardous elements in nuclear wastes comprising 50–70% by weight of quartz, 10–30% by weight of montmorillonite, 1–10% by weight of phosphate mineral, 1–10% by weight of ferrous mineral, 1–10% by weight of a sulfate mineral and 1–10% by weight of attapulgite.

2. The composition of claim 1, wherein the phosphate mineral is apatite and the sulfate mineral is anhydrite.

3. The composition of claim 1, wherein the ferrous mineral is olivine, garnet, magnetite or pyrite.

4. The composition of claim 1, comprising 55–65% by weight of quartz, 15–25% by weight of montmorillonite, 3–7% by weight of apatite, 3–7% by weight of olivine, garnet, magnetite or pyrite, 3–7% by weight of anhydrite and 3–7% by weight of attapulgite.

5. The composition of claim 1, comprising 55–65% by weight of quartz, 15–25% by weight of montmorillonite, 3–7% by weight of apatite, 3–7% by weight of olivine or magnetite and 3–7% by weight of attapulgite.

6. In a process for the disposal of nuclear wastes by burial of sealed canisters of the wastes in holes in tunnels in rock and backfilling the holes around each sealed canister with a mixture of quartz and clay, the improvement of employing a backfill composition comprising 50–70% by weight of quartz, 10–30% by weight of montmorillonite, 1–10% by weight of phosphate mineral, 1–10% by weight of ferrous mineral, 1–10% by weight of a sulfate mineral and 1–10% by weight of attapulgite.

7. The process of claim 6, wherein the ferrous mineral is olivine, garnet, magnetite or pyrite.

8. The process of claim 6, wherein the backfill composition comprises 55–65% by weight of quartz, 15–25% by weight of montmorillonite, 3–7% by weight of apatite, 3–7% by weight of olivine, garnet, magnetite or pyrite, 3–7% by weight of anhydrite and 3–7% by weight of attapulgite.

9. The process of claim 6, wherein the backfill composition comprises 55–65% by weight of quartz, 15–25% by weight of montmorillonite, 3–7% by weight of apatite, 3–7% by weight of olivine or magnetite and 3–7% by weight of attapulgite.

10. The process of claim 6, wherein the phosphate mineral is apatite and the sulfate mineral is anhydrite.

* * * * *